US012157651B2

(12) United States Patent
Breysse et al.

(10) Patent No.: US 12,157,651 B2
(45) Date of Patent: Dec. 3, 2024

(54) FEEDER DEVICE FOR FEEDING MAILPIECES TO A POSTAL SORTING CONVEYOR

(71) Applicant: SOLYSTIC, Bagneux (FR)

(72) Inventors: Steve Breysse, Beauchastel (FR); Jean-Michel Reboul, Saint Donat (FR); Jean-Marc Teluob, Cornas (FR)

(73) Assignee: SOLYSTIC, Bagneux (FR)

( * ) Notice: Subject to any disclaimer, the term of this patent is extended or adjusted under 35 U.S.C. 154(b) by 851 days.

(21) Appl. No.: 16/967,520

(22) PCT Filed: Jun. 19, 2020

(86) PCT No.: PCT/EP2020/067068
§ 371 (c)(1),
(2) Date: Aug. 5, 2020

(87) PCT Pub. No.: WO2020/254556
PCT Pub. Date: Dec. 24, 2020

(65) Prior Publication Data

US 2023/0174329 A1 Jun. 8, 2023

(30) Foreign Application Priority Data

Jun. 20, 2019 (FR) ..... 1906687

(51) Int. Cl.
*B65H 3/04* (2006.01)
*B65H 1/02* (2006.01)
(Continued)

(52) U.S. Cl.
CPC ..... *B65H 3/045* (2013.01); *B65H 1/025* (2013.01); *B65H 3/124* (2013.01); *B65H 3/66* (2013.01);
(Continued)

(58) Field of Classification Search
CPC ..... B65H 3/045; B65H 1/025; B65H 3/124; B65H 3/66; B65H 7/02; B65H 2511/21;
(Continued)

(56) References Cited

U.S. PATENT DOCUMENTS 3,981,493 A 9/1976 Klappenecker et al.
6,217,020 B1 * 4/2001 Supron ..... B65H 1/025 271/149

(Continued)

FOREIGN PATENT DOCUMENTS

WO 2014/164719 A1 10/2014

OTHER PUBLICATIONS

French Search Report dated Mar. 68, 2020 issued by INPI from corresponding Application No. FR 1906687, 1 page.

(Continued)

*Primary Examiner* — Howard J Sanders
(74) *Attorney, Agent, or Firm* — Ware, Fressola, Maguire & Barber LLP

(57) ABSTRACT

A feeder device for feeding mailpieces to a postal sorting conveyor has an unstacker head designed to put the mailpieces in series and on edge on the sorting conveyor, an unstacker plate designed to unstack the mailpieces one-by-one towards the unstacker head, and a mailpiece feed conveyor designed to convey the mailpieces in a stack and on edge against the unstacker plate. The unstacker plate has a stationary portion that extends from the unstacker head, and a moving portion that extends the stationary portion, said moving portion being mounted to pivot from the stationary portion between a first position in which the stationary portion and the moving portion are aligned with each other, and a second position in which the stationary portion and the moving portion are angularly offset relative to each other.

11 Claims, 3 Drawing Sheets

(51) Int. Cl.
*B65H 3/12* (2006.01)
*B65H 3/66* (2006.01)
*B65H 7/02* (2006.01)

(52) U.S. Cl.
CPC ..... *B65H 7/02* (2013.01); *B65H 2511/21* (2013.01); *B65H 2513/10* (2013.01); *B65H 2513/41* (2013.01); *B65H 2701/1916* (2013.01)

(58) Field of Classification Search
CPC ..... B65H 2513/10; B65H 2513/41; B65H 2701/1916; B65H 29/16; B65H 29/242; B65H 29/38; B65H 29/40; B65H 2301/443246; B65H 2301/4432; B65H 2404/63
See application file for complete search history.

(56) References Cited

U.S. PATENT DOCUMENTS

| | | | | |
|---|---|---|---|---|
| 8,096,548 | B2 * | 1/2012 | Iwami | B65H 3/0638 271/119 |
| 8,419,005 | B2 * | 4/2013 | Nomiyama | B65H 83/025 271/3.02 |
| 10,131,513 | B2 * | 11/2018 | Brown | B65H 3/124 |
| 2007/0052154 | A1 | 3/2007 | Mitsuya | |

OTHER PUBLICATIONS

International Search Report and Written Opinion, Application No. PCT/EP2020/067068, mailed Sep. 23, 2020, 19 pages.

* cited by examiner

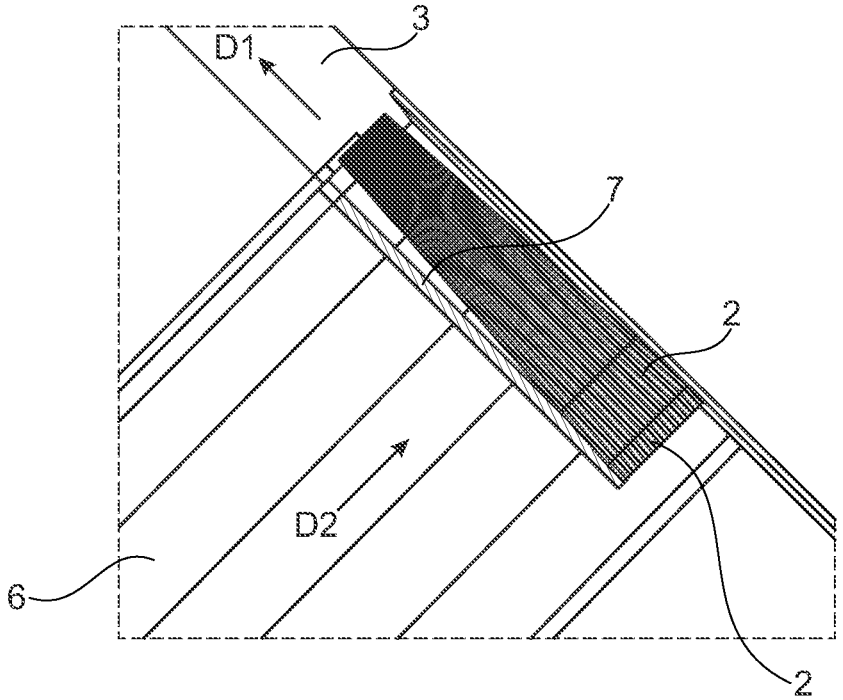
Fig. 1 - PRIOR ART -
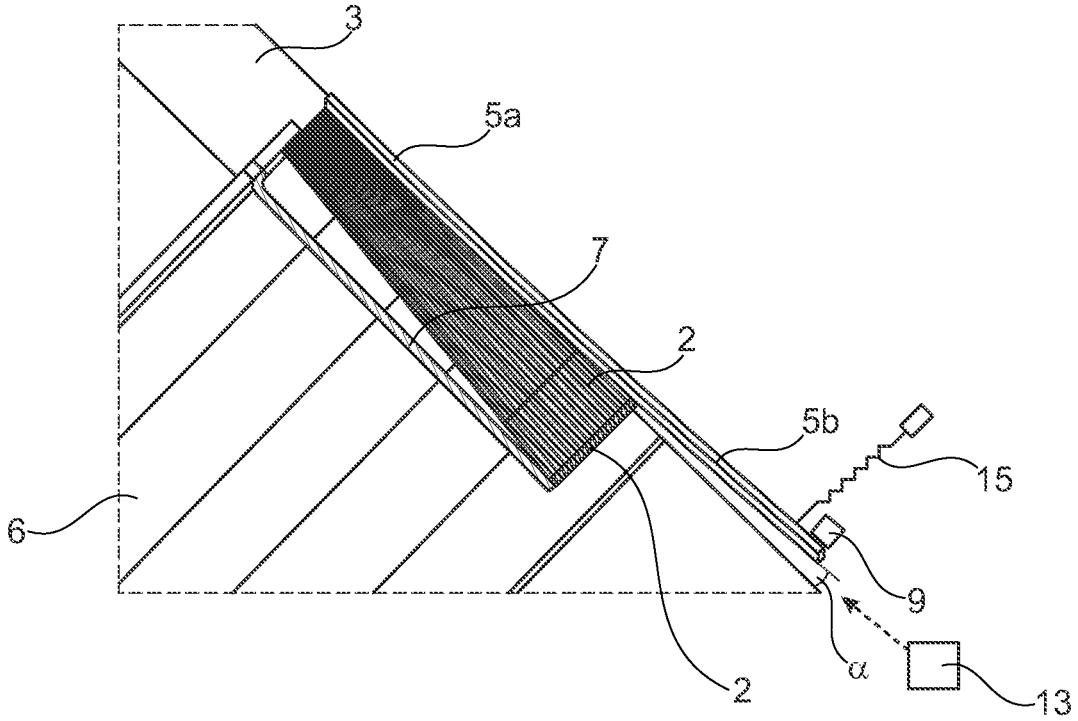
Fig. 2

FEEDER DEVICE FOR FEEDING MAILPIECES TO A POSTAL SORTING CONVEYOR

CROSS REFERENCE TO RELATED APPLICATIONS

This application is the U.S. National Stage of PCT/EP2020/067068 filed on Jun. 19, 2020, which application claims priority under 35 USC § 119 to French Patent Application No. 1906687 filed on Jun. 20. 2019. Both of these applications are hereby incorporated by reference in their entirety.

TECHNICAL FIELD

The invention lies in the field of postal sorting and relates more particularly to feeder devices for feeding mailpieces to postal sorting conveyors.

PRIOR ART

Generally, a feeder device for a postal sorting conveyor includes an unstacker head suitable for putting the mailpieces in series and on edge on the sorting conveyor.

An unstacker plate also extends upstream from the unstacker head for the purpose of unstacking the mailpieces one-by-one towards the unstacker head, and a mailpiece feed conveyor is provided for conveying the mailpieces in a stack on edge and flatly against the unstacker plate.

This type of feeder device is used in postal sorting centers for feeding flat mailpieces to sorting conveyors.

The term "flat mailpiece" is used to mean a mailpiece having a flat surface that is to be in contact with the unstacker plate, such as a letter or a magazine.

Such mailpieces are then suitable for constituting a rectangular block shaped stack of mailpieces that is in contact with the unstacker plate.

The feeder device is also equipped with detectors that are designed to detect whether the unstacker plate is in contact with the mailpiece disposed at the head of the stack.

Thus, when all of the detectors detect contact with said mailpiece, the unstacker plate is activated for unstacking the mailpiece.

It can thus be understood that the speed of unstacking of the mailpieces from the stack depends, in particular, on the speed of detection by the detectors of the mailpiece at the head of the stack.

It can happen that certain mailpieces have surfaces with zones of additional thickness, such mailpieces being referred to as "non-flat" mailpieces.

For example, a non-flat mailpiece is in the form of a magazine accompanied by a letter sent to the recipient, the resulting mailpiece being wrapped in a paper envelope or wrapping.

In such a situation, the stack of mailpieces is in the shape of a trapezium in contact with the unstacker plate, as shown in FIG. 1.

In this example, the accompanying letter forms additional thickness at one end of the magazine.

At least one detector not detecting the mailpiece at the head of the stack stops the unstacking and forces the feeder device to press the stack tightly against the unstacker plate until the mailpiece has been detected by all of the detectors.

The first mailpiece in the stack is then unstacked despite the high pressure from the stack.

The risks of jamming between the unstacker plate and the remainder of the stack are thus increased, as are the risks of overlapping with another mailpiece, and the risks of damage to the mailpiece itself while in contact with the unstacker plate.

SUMMARY OF THE INVENTION

An object of the invention is to remedy the above-mentioned problems.

To this end, the invention provides a feeder device for feeding mailpieces to a postal sorting conveyor, said feeder device comprising an unstacker head designed to put the mailpieces in series and on edge on the sorting conveyor, an unstacker plate extending upstream from the unstacker head and designed to unstack the mailpieces one-by-one towards the unstacker head, and a mailpiece feed conveyor designed to convey the mailpieces in a stack on edge and flatly against the unstacker plate, said feeder device being characterized in that the unstacker plate extends within the width of the feed conveyor only, between a first plate end and a second plate end opposite from the first plate end, said unstacker plate comprising a stationary portion that extends longitudinally on the feed conveyor from the unstacker head to form the first plate end, said stationary portion being designed to move the mailpieces one-by-one towards the unstacker head, said unstacker plate further comprising a moving portion that extends the stationary portion on the feed conveyor to form the second plate end, said moving portion being designed to be passive in moving the mailpieces towards the unstacker head, and in that said moving portion is mounted to pivot from the stationary portion between a first position in which the stationary portion and the moving portion are aligned with each other, and a second position in which the stationary portion and the moving portion are angularly offset relative to each other.

The basic idea of the invention consists in angularly offsetting the moving portion relative to the stationary portion when the zone of additional thickness of the mailpiece at the head of the stack is pressing against said moving portion.

The pressure exerted by the stack at the time of unstacking on the mailpiece at the head of the stack is thus significantly relaxed.

It can be understood that the entire surface of the mailpiece at the head of the stack, i.e. a surface with and without additional thickness, then finds itself substantially aligned in the unstacking direction, i.e. parallel to the stationary portion of the unstacker plate, thereby limiting the above-mentioned risks.

The unstacker plate is thus not only adapted to unstack flat mailpieces without any angular offset of the moving portion, but is also adapted to unstack mailpieces having non-flat surfaces without disturbing the unstacking.

The unstacker device of the invention may have the following features:

- it further comprises sensors designed to determine a pivot amplitude through which the moving portion pivots, and a monitoring and control unit designed to control the speed and/or the direction of conveying of the feed conveyor when the pivot amplitude through which the moving portion pivots exceeds a certain threshold value;
- the feed conveyor includes a downstream conveying portion that is segmented into a plurality of conveyor belts in line abreast across the width of the conveyor, which conveyor belts have their speeds and/or conveying directions controlled independently from one another by the monitoring and control unit when the pivoting of the moving portion exceeds said certain threshold value;

the stationary portion and the moving portion each have a respective suction system for holding the mailpieces against the unstacker plate, the stationary portion has a drive belt system for moving the mailpieces towards the unstacker head, and said suction systems and said drive belt system are controlled independently from one another by the monitoring and control unit when the pivoting of the moving portion exceeds said certain threshold value;

the feeder device further comprises an abutment that is fastened behind the unstacker plate relative to the feed conveyor, said abutment being designed to prevent pivoting of the moving portion beyond the second position;

the unstacker plate further comprises return means that are designed to bring the moving portion from the second position to the first position when the unstacker plate is not in contact with a mailpiece; and the feeder device further comprises a moving paddle mounted to move on the feed conveyor and designed to hold the stack of mailpieces in a stack and on edge against the unstacker plate, and the monitoring and control unit is designed to control the speed and/or the direction of movement of the moving paddle when the pivot amplitude through which the moving portion of the unstacker plate pivots exceeds said certain threshold value.

BRIEF DESCRIPTION OF THE DRAWINGS

The present invention can be better understood and other advantages appear on reading the following detailed description of the invention given by way of non-limiting example and with reference to the accompanying drawings, in which:

FIG. 1 is a diagrammatic view of a stack of mailpieces having non-flat surfaces arriving facing a prior art unstacker plate;

FIG. 2 is a diagrammatic view of a stack of mailpieces having non-flat surfaces arriving facing an unstacker plate of the invention;

DETAILED DESCRIPTION OF THE INVENTION

Figure 3:
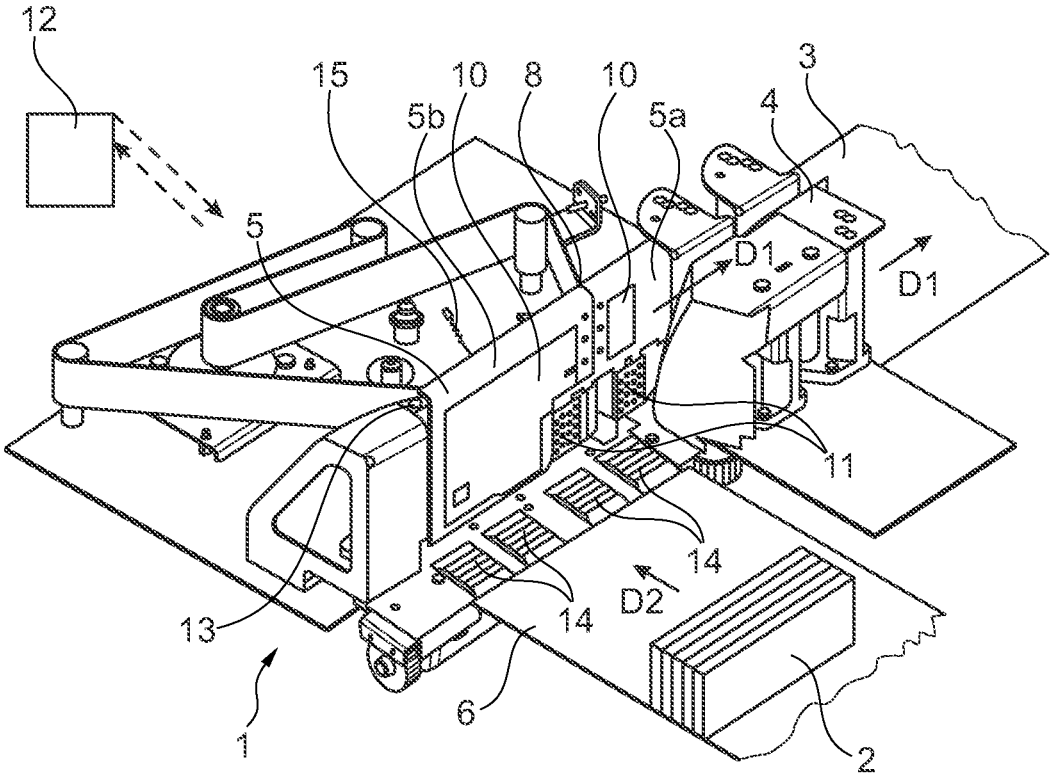
FIG. 3 is a diagrammatic view of a feeder device of the invention.

FIG. 3 shows a feeder device 1 of the invention for feeding mailpieces 2 to a postal sorting conveyor 3.

In this example, the feeder device 1 comprises an unstacker head 4 of known type that is designed to put the mailpieces 2 in series and on edge on the sorting conveyor in a first conveying direction D1.

An unstacker plate 5 of the feeder device 1 also extends upstream from the unstacker head 4 so as to unstack the mailpieces 2 one-by-one towards the unstacker head 4.

The feeder device 1 of the invention further comprises a mailpiece feed conveyor 6 designed to convey the mailpieces 2 in a stack on edge and flatly against the unstacker plate 5 in a second conveying direction D2.

A moving paddle 7, shown in FIGS. 1 and 2, moving on the feed conveyor 6 may also be used in this example for holding the stack of mailpieces 2 in a stack and on edge against the unstacker plate 5.

Thus, it can be understood that the mailpieces 2 remain on edge from moving on the feed conveyor 6 to being put in series on the sorting conveyor 3.

More precisely, in this example, the unstacker plate 5 comprises a stationary plate portion 5*a* that extends from the unstacker head and a moving plate portion 5*b* that extends the stationary portion 5*a*.

Figure 4:
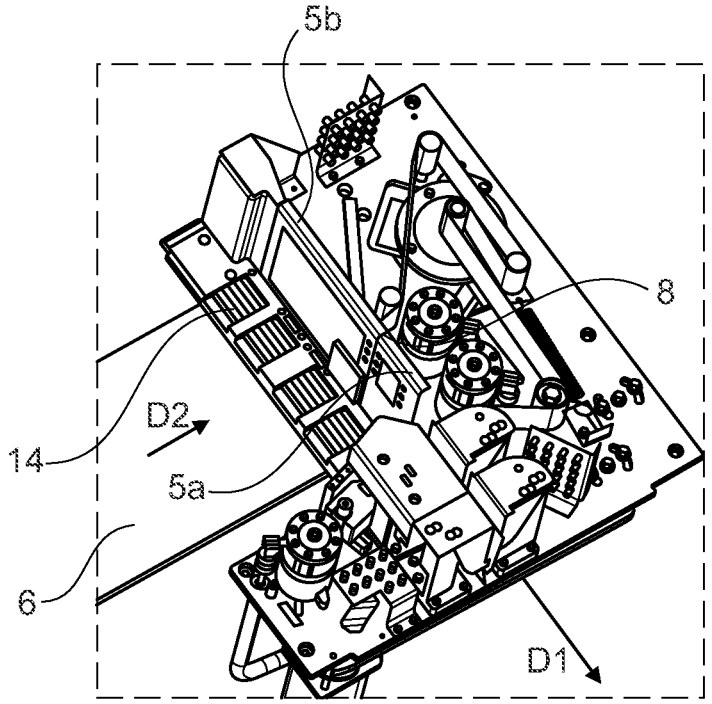
FIG. 4 is a diagrammatic view of a feeder device of the invention when the unstacker plate is in a first position.
Figure 5:
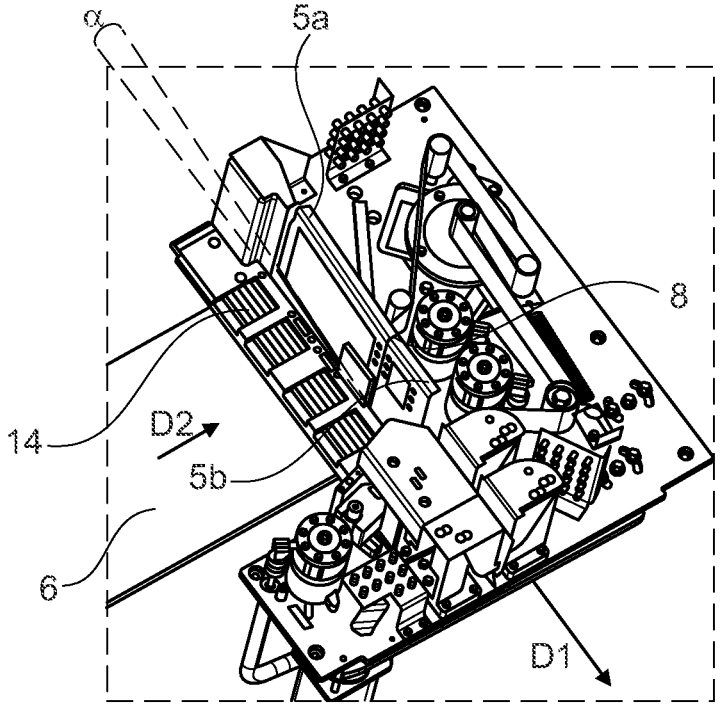
FIG. 5 is a diagrammatic view of a feeder device of the invention when the unstacker plate is in a second position.

As shown in FIGS. 4 and 5, the stationary portion 5*a* forms a first end of the unstacker plate while the moving portion 5*b* forms a second end of the unstacker plate that is opposite from the first plate end.

In this example, the unstacker plate is arranged in such a manner that the two plate ends extend within the width of the feed conveyor, i.e. the unstacker plate extends only within the width of the feed conveyor.

The stationary portion 5*a* extends longitudinally over the feed conveyor from the unstacker head to form the first plate end.

The stationary portion is, in particular, designed to move the mailpieces 2 one-by-one towards the unstacker head 4.

The moving portion 5*b* extends the stationary portion longitudinally on the feed conveyor to form the second plate end.

In this example, the moving portion 5*b* is designed to be passive in moving the mailpieces 2 towards the unstacker head.

The term "passive" should be understood to mean that the moving portion 5*b* does not have means for putting the mailpieces 2 in motion towards the unstacker head. The moving portion 5*b* is thus designed to receive the mailpieces 2 flatly.

The moving portion 5*b* is mounted to pivot from the stationary portion 5*a*, in this example by means of a hinge 8, between a first position in which the stationary portion 5*a* and the moving portion 5*b* are aligned with each other, as shown in FIG. 3, and a second position in which the stationary portion 5*a* and the moving portion 5*b* are offset angularly, as shown in FIG. 2, by an angle $\alpha$.

As shown in FIG. 4, the stationary portion 5*a* and the moving portion 5*b* are aligned in a plane in the first position so as to form a façade perpendicular to the feed conveyor 6 for receiving mailpieces 2 conveyed by the feed conveyor 2.

In particular, the moving portion 5*b* and the stationary portion 5*a* have a certain height that is adapted to receive mailpieces 2 of various sizes.

As shown in FIG. 5, the moving portion 2*b* is offset angularly relative to the plane in the second position so that an angular space is left free between the plane and the moving plate 5*a*, following on from the stationary portion and over the entire height of the moving portion 5*b*. It can thus be understood that the largest gap between the plane and the plate is situated at the second end terminating the unstacker plate.

By means of this arrangement, the passive moving portion 5*b* is suitable for pivoting to receive a mailpiece 2 having additional thickness over its entire height while also enabling the stationary portion also to receive the mailpiece 2 and to put it into motion towards the unstacker head 4.

It can be understood that the moving portion 5*b* pivoting makes it possible to fold the mailpiece in contact with the unstacker plate over its entire height.

The unstacker plate is designed not to have a prominent ridge between the moving portion 5*b* and the stationary portion 5*a* so as to prevent any catching of the mailpieces 2 that have additional thickness, e.g. of the envelope flap type.

The moving portion 5*b* and the stationary portion 5*a* may also form an L-shape, as shown in FIG. 3, fitting together to form the unstacker plate 5.

An abutment or stop 9 that can be seen in FIG. 2 is also fastened behind the unstacker plate 5 relative to the feed conveyor 6 in such a manner as to prevent the moving portion 5*b* from pivoting beyond the second position.

The pivot angle $\alpha$ through which the moving portion 5*a* pivots, which angle is shown in FIG. 2, is limited by the abutment 9 in the second position to an angle of less than 10°.

The moving portion 5*b* and the stationary portion 5*a* are provided with respective suction systems 10 for holding the mailpieces against the unstacker plate 5, and the stationary portion 5*a* is provided with a drive belt system 11 for moving the mailpieces towards the unstacker head 4.

Thus, the mailpiece 2 at the head of the stack can be unstacked despite the moving portion 5*b* of the unstacker plate 5 pivoting.

The feeder device 1 is also equipped with a monitoring and control unit 12 parameterized for controlling not only the suction systems 10 and the drive system 11, but also the feed conveyor 6 and the moving paddle 7.

For this purpose, the feeder device 1 is provided with sensors 13 that can be seen in FIGS. 2 and 3, and that are designed to determine a pivot amplitude through which the moving portion 5*a* pivots, which amplitude is defined, in this example, by the angle $\alpha$.

Thus, when the pivot amplitude through which the moving portion 5*a* pivots exceeds a certain threshold value, the monitoring and control unit 12 responds by simultaneously or independently controlling the speed and/or the direction of conveying of the feed conveyor 6, the suction system 10 and the drive system 11 of the moving portion 5*a* and/or of the stationary portion 5*b*, and the movement of the moving paddle 7.

More particularly, the feed conveyor 1 may have a downstream conveying portion that is segmented into a plurality of conveyor belts 14 in line abreast across the width of the feed conveyor 6.

In this situation, the speeds and/or the directions of conveying of the belts 14 are controlled independently from one another by the monitoring and control unit 12 when the pivoting of the moving portion (5*b*) exceeds the threshold value.

Thus, in order to enable the feed device 1 to be used both for mailpieces 2 having non-flat surfaces and for mailpieces 2 having flat surfaces, the unstacker plate 5 is equipped with return means 15, which can be seen in FIG. 2, and which are designed to bring the moving portion 5*b* from the second position to the first position when the unstacker plate 5 is not in contact with a mailpiece 2.

For example, the return means 15 are in the form of a spring or of resilient means.

It can be understood that the moving portion 5*b* of the unstacker plate 5 is not motor-driven in order to enable it to be angularly offset only under pressure from the first mailpiece 2 at the head of the stack.

For feeding a sorting conveyor 3 with mailpieces 2 having non-flat surfaces by using the feeder device 1 of the invention, the mailpieces 2 are firstly loaded in a stack and on edge onto the feed conveyor 6 for then being conveyed to the unstacker plate 5 of the feeder device 1.

In this example, the moving paddle 7 comes to hold the stack of mailpieces 2 on edge and to push it against the unstacker plate 5.

When the stack of mailpieces 2 has additional thickness facing the moving portion 5*b* of the unstacker plate 5, the moving paddle 7 pushes the portion of the stack of mailpieces that has additional thickness against the moving portion 5*b* of the unstacker plate 5, thereby causing the moving portion 5*b* to be offset angularly into the second position.

The monitoring and control unit 12 then receives a signal from the sensors 13, indicating that the moving portion 5*b* is in the second position.

Depending on the type of mailpieces 2 having non-flat surfaces, the monitoring and control unit 12 responds, for example, by causing the moving paddle 7 to move forwards or backwards relative to the unstacker plate 5, and by also causing the conveyor belts 14 of the feed conveyor 6 that are situated facing the moving portion 5*b* to move.

The monitoring and control unit 12 may also respond by activating the suction system 11 of the moving portion 5*b* and/or the suction system 11 and the drive system of the stationary portion 5*a*.

Naturally, this use of the monitoring and control unit 12 is to be taken by way of example, and numerous parameter settings make it possible to handle different situations with different non-flat mailpieces 2.

What is claimed is:

1. A feeder device for feeding mailpieces to a postal sorting conveyor, said feeder device comprising:

an unstacker head configured to put the mailpieces in series and on edge on the sorting conveyor, an unstacker plate extending upstream from the unstacker head and configured to unstack the mailpieces one-by-one towards the unstacker head, and a mailpiece feed conveyor configured to convey the mailpieces in a stack on edge and flatly against the unstacker plate, wherein the unstacker plate extends within the width of the feed conveyor only, between a first plate end and a second plate end opposite from the first plate end, said unstacker plate comprising a stationary portion that extends longitudinally on the feed conveyor from the unstacker head to form the first plate end, said stationary portion being configured to move the mailpieces one-by-one towards the unstacker head, said unstacker plate further comprising a moving portion which extends as a continuation of the stationary portion on the feed conveyor to form the second plate end, said moving portion being configured to be passive in moving the mailpieces towards the unstacker head, and in that said moving portion is designed to pivot regarding the stationary portion about a pivot axis extending vertically relative to the feed conveyor and between a first position in which the stationary portion and the moving portion extending in a same plane perpendicular to the feed conveyor , and a second position in which the stationary portion and the moving portion are angularly offset relative to each other in two distinct planes perpendicular to the feed conveyor.

2. The feeder device according to claim 1, further comprising sensors configured to determine a pivot amplitude through which the moving portion pivots, and a monitoring and control unit configured to control the speed and/or the direction of conveying of the feed conveyor when the pivot amplitude through which the moving portion pivots exceeds a certain threshold value.

3. The feeder device according to claim 2, wherein the feed conveyor includes a downstream conveying portion that is segmented into a plurality of conveyor belts in line abreast across the width of the conveyor, which conveyor belts have their speeds and/or conveying directions controlled independently from one another by the monitoring and control unit when the pivoting of the moving portion exceeds said certain threshold value.

4. The feeder device according to claim 3, wherein the stationary portion and the moving portion each have a respective suction system for holding the mailpieces against the unstacker plate, in that the stationary portion has a drive belt system for moving the mailpieces towards the unstacker head, and in that said suction systems and said drive belt system are controlled independently from one another by the monitoring and control unit when the pivoting of the moving portion exceeds said certain threshold value.

5. The feeder device according to claim 4, further comprising an abutment that is fastened behind the unstacker plate relative to the feed conveyor, said abutment being configured to prevent pivoting of the moving portion beyond the second position.

6. The feeder device according to claim 5, wherein the unstacker plate further comprises return means that are configured to bring the moving portion from the second position to the first position when the unstacker plate is not in contact with a mailpiece.

7. A feeder device according to claim 6, further comprising a moving paddle mounted to move on the feed conveyor and configured to hold the stack of mailpieces in a stack and on edge against the unstacker plate, and in that the monitoring and control unit is configured to control the speed and/or the direction of movement of the moving paddle when the pivot amplitude through which the moving portion of the unstacker plate pivots exceeds said certain threshold value.

8. The feeder device according to claim 2, wherein the stationary portion and the moving portion each have a respective suction system for holding the mailpieces against the unstacker plate, in that the stationary portion has a drive belt system for moving the mailpieces towards the unstacker head, and in that said suction systems and said drive belt system are controlled independently from one another by the monitoring and control unit when the pivoting of the moving portion exceeds said certain threshold value.

9. The feeder device according to claim 2, further comprising a moving paddle mounted to move on the feed conveyor and configured to hold the stack of mailpieces in a stack and on edge against the unstacker plate, and in that the monitoring and control unit is configured to control the speed and/or the direction of movement of the moving paddle when the pivot amplitude through which the moving portion of the unstacker plate pivots exceeds said certain threshold value.

10. The feeder device according to claim 1, further comprising an abutment that is fastened behind the unstacker plate relative to the feed conveyor, said abutment being configured to prevent pivoting of the moving portion beyond the second position.

11. The feeder device according to claim 1, wherein the unstacker plate further comprises return means that are configured to bring the moving portion from the second position to the first position when the unstacker plate is not in contact with a mailpiece.

* * * * *